US005315949A

United States Patent [19]

Bradley

[11] Patent Number: 5,315,949

[45] Date of Patent: May 31, 1994

[54] PROTECTIVE COVER FOR BOAT OUTCROPPING

[76] Inventor: William A. Bradley, 1636 S. Brookhurst St., Anaheim, Calif. 92804

[21] Appl. No.: 991,187

[22] Filed: Dec. 15, 1992

[51] Int. Cl.[5] ..... B63B 59/00

[52] U.S. Cl. ..... 114/222; 440/113

[58] Field of Search ..... 114/222; 440/113

[56] References Cited

U.S. PATENT DOCUMENTS

| | | | |
|---|---|---|---|
| 3,205,851 | 9/1965 | Wiswell | 114/222 |
| 3,685,477 | 8/1972 | Wood | 114/222 |
| 3,886,889 | 6/1975 | Burger | 440/113 |
| 4,046,094 | 9/1977 | Preiser et al. | 114/222 |
| 4,998,496 | 3/1991 | Shaw | 114/222 |
| 5,152,242 | 10/1992 | Bradley | 114/222 |

*Primary Examiner*—Michael S. Huppert
*Assistant Examiner*—Thomas J. Brahan

[57] ABSTRACT

An apparatus is provided for protectively covering an outcropping, such as a motor prop, of a boat. The cover includes an adjustable collar, a flexible, opaque bag, and an adjustable collar draw line. The bag has an open top end attached to the collar. A closed bottom end of the bag is opposed to the top end, and has a weight attached thereto. The adjustable collar draw line of the collar is such that with the bag placed over the outcropping, the open end of the bag may be closed around the outcropping by pulling the adjustable collar draw line. The collar includes a locking slot for locking the adjustable collar draw line in place around the outcropping. A manipulation handle removably attaches to the collar for facilitating the placement and removal of the cover onto and off of the outcropping. With the cover in place over the outcropping, water and light are prevented from entering the interior of the bag, whereby water borne life forms such as filter feeding creatures and plant life cannot thrive within the cover. As such, the outcropping is kept virtually free of water borne life forms while the outcropping is covered.

2 Claims, 2 Drawing Sheets

PROTECTIVE COVER FOR BOAT OUTCROPPING

FIELD OF THE INVENTION

This invention relates generally to protective covers, and, more particularly, is directed towards a protective cover for an outcropping of a boat, such as a motor prop or the like.

BACKGROUND OF THE INVENTION

Shrouds for the hull of a boat or ship are known in the prior art, and generally are used to prevent water borne organisms from thriving about and growing upon the hull. Shrouds of this type prevent the decrease in aquadynamic performance caused by such organisms attaching to the hull and increasing aquadynamic drag when the boat is in motion. Further, such shrouds tend to keep the surface of the hull from becoming damaged by water borne organisms, and also eliminate the need for poisonous hull coatings, and the like. Clearly, there are many advantages to such hull shrouds, as is taught in my previous U.S. Pat. No. 5,152,242 issued on Oct. 6, 1992.

While prior art shrouds are suitable for protecting boat hulls, such shrouds to not typically extend inexpensive protection to boat outcroppings such as engine props and rudders. Further, these prior art devices are difficult to install and require complex and time consuming attachment mechanisms. Because outcroppings are usually not protected with anti-fouling coatings such as hull paint, the growth on such outcroppings is more pronounced than on coated hull surfaces. Water organisms grow on such outcroppings just as easily as they grow on hulls, due to the fact that such outcroppings are continuously submerged. Consequently, prior art shrouds are not in great use today.

Clearly, then, a protective covering device is needed to protect boat outcroppings such as motor props and rudders from water borne organisms, including both plant and animal life. Such a needed device would be easy to install and remove from the outcroppings, and would prevent both light and water from entering the protected volume around the outcroppings. Further, such a needed device would be inexpensive to manufacture and would not require professional installation or set-up. The present invention fulfills these needs and provides further related advantages.

SUMMARY OF THE INVENTION

The present invention is a protective cover for an outcropping, such as a motor prop, of a boat. The cover includes an adjustable collar, a flexible, opaque bag, and an adjusting means. The bag has an open top end that includes an attachment means for attachment of the bag to the collar. A closed bottom end of the bag is opposed to the top end, and preferably has attached thereto a weight for ballast in holding the bag in a submerged position. An adjusting means of the collar is included for adjusting the collar such that with the bag placed over the outcropping, the open end of the bag may be closed around the outcropping in order to exclude light and water from entering the interior of the bag.

The collar includes a first tubular, rigid, U-shaped portion having an open end. A second, adjustable, flexible portion is positioned so as to close the open end of the U-shaped portion. The flexible portion is adapted to be drawn tightly across the open end of the U-shaped portion by the adjusting means. Preferably, the adjusting means includes a locking means for locking the flexible portion in place after the flexible portion has been drawn tightly around the outcropping. An adapter means is fixedly attached to the U-shaped portion and includes a mutual engagement means for disengagable attachment to a manipulation means. The manipulation means, when engaged with the engagement means of the adapter means, facilitates the placement and removal of the cover onto and off of the outcropping from a position of at least several feet away from the outcropping. Once the cover has been secured onto the outcropping, the manipulation means may be disengaged from the adapter means and stored. A line is included with the cover, one end of the line being attached to the weight to facilitate the manual manipulation of the cover onto and off of the outcropping.

With the cover in place over the outcropping, water and light are prevented from entering the interior of the bag, whereby water borne life forms such as filter feeding creatures and plant life cannot thrive within the cover. As such, the outcropping is kept virtually free of water borne life forms while the outcropping is covered.

The present invention protects boat outcroppings, such as motor props and rudders, from both plant and animal water borne organisms. The present protective cover is easy to install and remove from the outcroppings, and prevents both light and water from entering the protected volume around the outcroppings. Further, the present device is inexpensive to manufacture and does not require professional installation or set-up. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
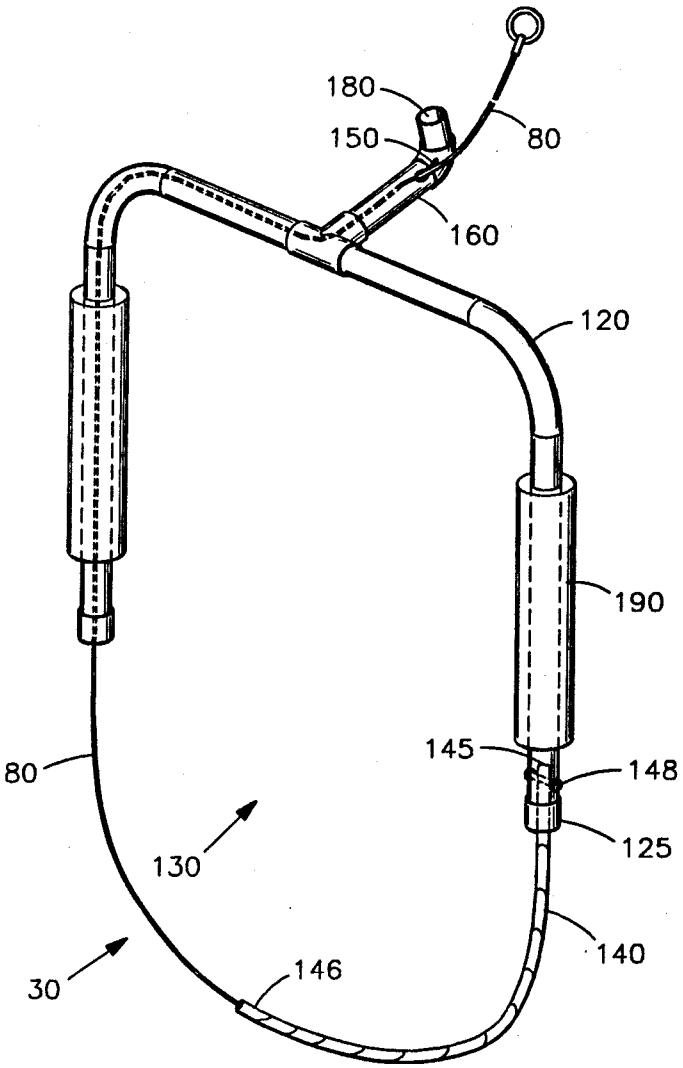
FIG. 2 is a perspective illustration of a collar of the cover of FIG. 1, illustrating the adjusting means as connected to a flexible portion of the collar.
Figure 1:
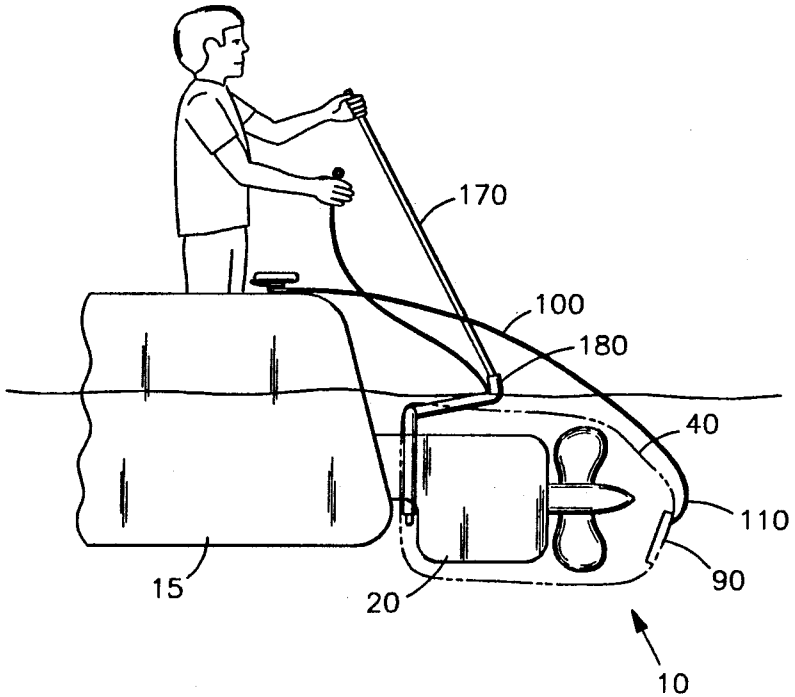
FIG. 1 is a left side elevational view of the invention, illustrating a cover fitted around an outcropping of a boat, the cover being manipulated by a manipulation means and an adjusting means.
Figure 3:
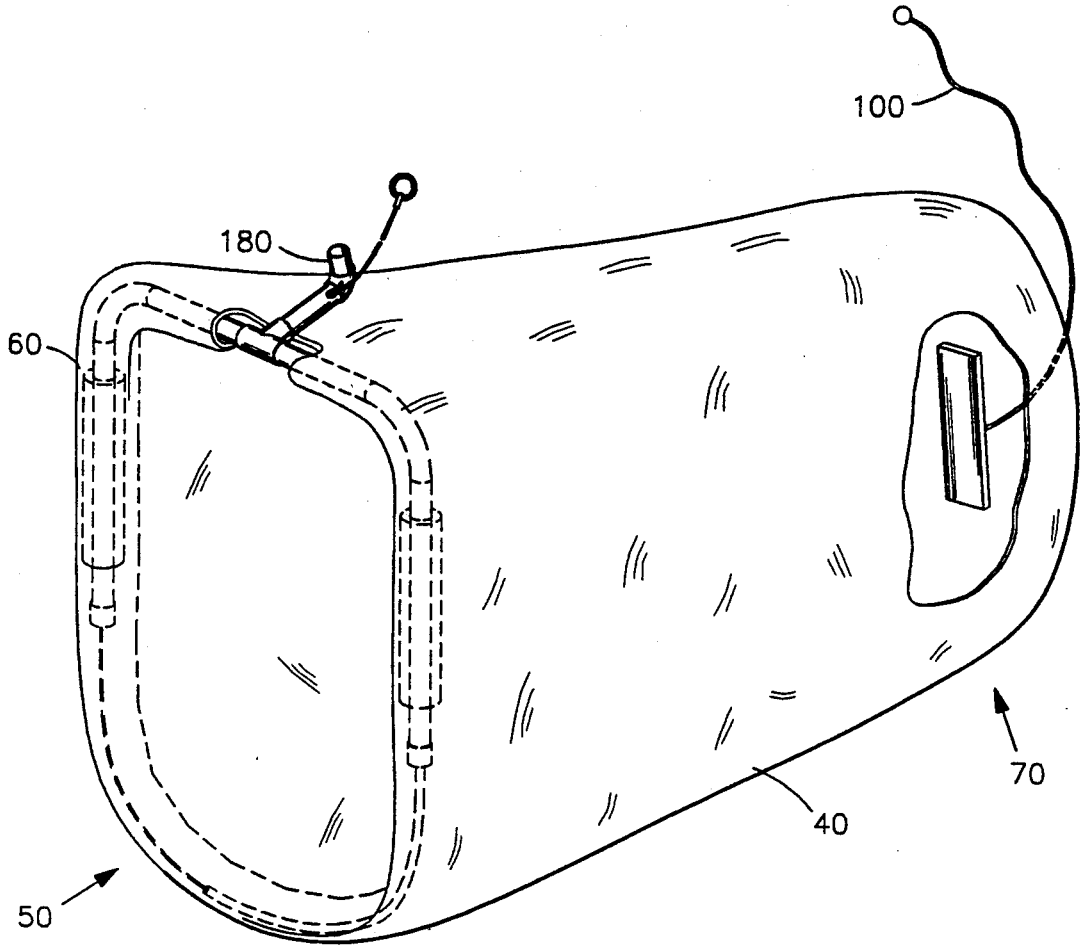
FIG. 3 is perspective illustration of the invention, illustrating a bag of the cover in an open position for receiving the outcropping of the boat.
Figure 4:
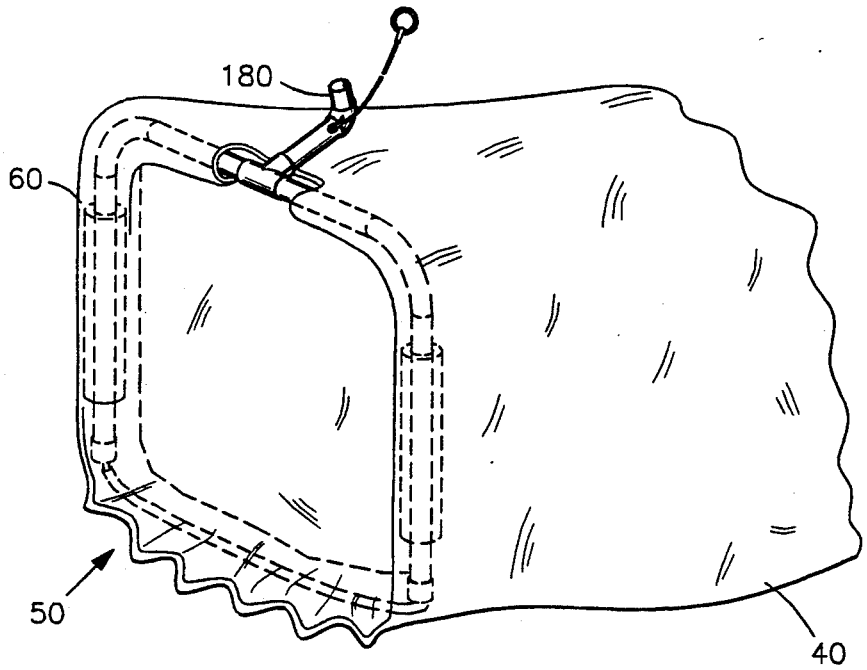
FIG. 4 is a perspective illustration of the invention, illustrating the bag of FIG. 3 in a closed position, as when fitted tightly around the outcropping of the boat.

FIGS. 1 and 2 show a protective cover 10 for an outcropping 20, such as a prop, of a boat 15. The cover 10 includes an adjustable collar 30, a bag 40, and an adjusting means 80. The bag 40 is made from a water impermeable, flexible, opaque sheet material, such as plastic or fabric sheet material, and has an open top end 50 that includes an attachment means 60 for attachment of the bag 40 to the collar 30. Such attachment means 60 may be a sewn loop of the sheet material, snaps, or other means (FIG. 3). A closed bottom end 70 of the bag 40 is opposed to the top end 50, and preferably has attached thereto a weight 90 for ballast in holding the bag 40 in a submerged position. The weight 90 may be attached to the closed bottom end 70 of the bag 40 by any suitable chemical bonding means or mechanical attachment means.

An adjusting means 80 of the collar 30 is included for adjusting the collar 30 such that with the bag 40 placed over the outcropping 20, the open end 50 of the bag 40 may be closed around the outcropping in order to exclude light and water from entering the interior of the bag 40. Such an adjusting means 80 may be a length of flexible rope, cable, or the like, slidably captured within the collar 30 (FIG. 2).

In the preferred mode of the invention, the collar 30 includes a first tubular, rigid, U-shaped portion 120 having an open end 130. A second, adjustable, flexible portion 140 is positioned so as to close the open end 130 of the U-shaped portion 120. One end 145 of the flexible portion 140 is fixedly attached, with an attachment means 148, to one end 125 of the U-shaped portion 120. The other end 146 of the flexible portion 140 is fixedly attached to the adjusting means 80. As such, the flexible portion 140 is adapted to be drawn tightly across the open end 130 of the U-shaped portion 120 by the adjusting means 80. Preferably, the adjusting means 80 includes a locking means 150 for locking the flexible portion 140 in place after the flexible portion 140 has been drawn tightly around the outcropping 20.

An adapter means 160 is preferably fixedly attached to the U-shaped portion 120, and includes a mutual engagement means 180 for disengagable attachment to a manipulation means 170. Both the adapter means 180 and the manipulation means 170 may be readily manufactured from rigid tubing, or the like. The manipulation means 170, when engaged with the engagement means 180 of the adapter means 160, facilitates the placement and removal of the cover 10 onto and off of the outcropping 20 from a position of at least several feet away from the outcropping 20. Once the cover 10 has been secured onto the outcropping 20, the manipulation means 170 may be disengaged from the adapter means 160 and stored.

A line 100 is preferably included with the cover 10, one end 110 of the line 100 being attached to the weight 90 to facilitate the manual manipulation of the cover 10 onto and off of the outcropping 20. Further, foam or rubber bumpers 190 are attached to each leg of the U-shaped portion 120 for protecting the boat 15 from potentially damaging contact with the U-shaped portion 120.

In operation, the manipulation means 170 is engaged with the adapter means 160, and the cover 10 is manually maneuvered to cover the outcropping 20. The adjusting means 80 is then drawn such that the flexible portion 140 of the collar 30 is drawn tightly around the U-shaped portion 120 of the collar 30, thereby holding the cover 10 in place around the outcropping 20. The adjusting means 80 is then locked into place with the locking means 150. Consequently, water and light are prevented from entering the interior of the bag 40, and, as such, water borne creatures, such as filter feeding creatures, and plant life cannot thrive within the cover 10. As a result, the outcropping 20 will remain generally free of plant life, barnacles, and the like, while covered.

To remove the cover 10 from the outcropping 20, the manipulation means 170 is engaged with the adapter means 60, and the adjusting means 80 is loosened from the locking means 150. The weight of the flexible portion 140 and the adjusting means 80 causes it to sink. The line 100 that is attached to the weight 90 is then pulled, whereby the closed bottom end 70 of the bag 40 is lifted above the open top end 50 of the bag 40, allowing the water trapped within the bag 40 to flow out of the bag 40. The manipulation means 170 is then used to push the cover 10 away from the outcropping 20, and then the manipulation means 170 and the line 100 are simultaneously pulled out of the water to free the outcropping 20.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A protective cover for a boat stern drive comprising:

an adjustable collar including a first tubular, fixed U-shaped portion defining an open end of the U-shaped portion, and a second, adjustable, flexible portion, the flexible portion being positioned so as to close the open end of the U-shaped portion, and adapted to be drawn tightly across the U-shaped portion;

a bag made of water impermeable, flexible, opaque, sheet material, the bag having an open top end providing a means for attachment of the bag to the collar, and a closed bottom end in opposition to the top end; and a means for adjusting the collar so that with the bag lowered along a transom around a stern drive, the open end of the bag may be closed around the drive in order to exclude light from the interior of the bag so that water borne creature cannot thrive within the cover.

2. The cover of claim 1 further including adaptor means, attached to the U-shaped portion and manipulation means, the adaptor means and the manipulation means having mutual engagement means for providing support and placement of the cover onto the outcropping from a position at least several feet distant from said outcropping, the manipulation means thereafter being disengagable from the adaptor means.

* * * * *